US010796645B2

(12) United States Patent
Yun et al.

(10) Patent No.: US 10,796,645 B2
(45) Date of Patent: Oct. 6, 2020

(54) DISPLAY APPARATUS AND METHOD OF DRIVING THE SAME

(71) Applicant: Samsung Display Co., Ltd., Yongin-Si, Gyeonggi-Do (KR)

(72) Inventors: Jungmi Yun, Hwaseong-si (KR); Minyoung Park, Busan (KR); Kihyun Pyun, Gwangmyeong-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 16/205,529

(22) Filed: Nov. 30, 2018

(65) Prior Publication Data

US 2019/0172402 A1 Jun. 6, 2019

(30) Foreign Application Priority Data

Dec. 6, 2017 (KR) ..... 10-2017-0167058

(51) Int. Cl.
*G09G 3/34* (2006.01)
*G09G 3/20* (2006.01)

(52) U.S. Cl.
CPC ..... *G09G 3/3406* (2013.01); *G09G 3/20* (2013.01); *G09G 2310/0202* (2013.01); *G09G 2310/0267* (2013.01); *G09G 2320/0233* (2013.01)

(58) Field of Classification Search
CPC ... G09G 2310/0202; G09G 2310/0267; G09G 2320/0233; G09G 3/20; G09G 3/3406
See application file for complete search history.

(56) References Cited

U.S. PATENT DOCUMENTS

| | | | | |
|---|---|---|---|---|
| 6,342,016 | B1 | 1/2002 | Parker | |
| 6,961,034 | B2 * | 11/2005 | Kusanagi | G09G 3/3648 345/211 |
| 7,654,471 | B2 | 2/2010 | Johnson | |
| 9,495,923 | B2 * | 11/2016 | Shiomi | G09G 3/2074 |
| 2008/0224984 | A1 * | 9/2008 | Chang | G09G 3/3614 345/100 |
| 2008/0252587 | A1 * | 10/2008 | Wang | G09G 3/20 345/100 |
| 2014/0085279 | A1 * | 3/2014 | Shiomi | G09G 3/2074 345/204 |
| 2015/0054818 | A1 * | 2/2015 | Cho | G09G 3/3648 345/213 |
| 2016/0180776 | A1 * | 6/2016 | Cho | G09G 3/20 345/215 |
| 2017/0004798 | A1 * | 1/2017 | Park | G09G 3/3648 |
| 2018/0286304 | A1 * | 10/2018 | Park | G09G 3/22 |

* cited by examiner

*Primary Examiner* — Dmitriy Bolotin
(74) *Attorney, Agent, or Firm* — Cantor Colburn LLP

(57) ABSTRACT

A display apparatus includes a display panel, a gate driver, a data driver and a backlight assembly. The display panel includes a plurality of display blocks. The gate driver outputs a gate signal to the display panel. The data driver outputs a data voltage to the display panel. The backlight assembly provides light to the display panel. Sequences of outputting the gate signals from the gate driver to the display blocks are different from each other in adjacent frames.

17 Claims, 21 Drawing Sheets

| CB | CS |
|---|---|
| 00 | 1000 |
| 01 | 0100 |
| 10 | 0010 |
| 11 | 0001 |

FIG. 10

| | Frame2 | Frame3 | Frame4 | Frame5 |
|---|---|---|---|---|
| OUT1 | HIGH | HIGH | HIGH | HIGH |
| OUT2 | HIGH | HIGH | HIGH | HIGH |
| OUT3 | HIGH | HIGH | HIGH | HIGH |
| OUT4 | LOW | LOW | LOW | LOW |

| | Frame2 | Frame3 | Frame4 | Frame5 |
|---|---|---|---|---|
| OUT1 | HIGH | HIGH | LOW | HIGH |
| OUT2 | HIGH | LOW | HIGH | HIGH |
| OUT3 | LOW | HIGH | HIGH | LOW |
| OUT4 | HIGH | HIGH | LOW | HIGH |

FIG. 15

| | Frame1 | Frame2 | Frame3 | Frame4 |
|---|---|---|---|---|
| GIC1 | 1 | 4 | 3 | 2 |
| GIC2 | 2 | 1 | 4 | 3 |
| GIC3 | 3 | 2 | 1 | 4 |
| GIC4 | 4 | 3 | 2 | 1 |

FIG. 17

| | Frame1 | Frame2 | Frame3 | Frame4 |
|---|---|---|---|---|
| GIC1 | 1 | 3 | 1 | 3 |
| GIC2 | 2 | 4 | 2 | 4 |
| GIC3 | 3 | 1 | 3 | 1 |
| GIC4 | 4 | 2 | 4 | 2 |

FIG. 19

| | Frame1 | Frame2 | Frame3 | Frame4 |
|---|---|---|---|---|
| GIC1 | 1 | 4 | 3 | 2 |
| GIC2 | 2 | 1 | 4 | 3 |
| GIC3 | 3 | 2 | 1 | 4 |
| GIC4 | 4 | 3 | 2 | 1 |

FIG. 21

| | Frame1 | Frame2 | Frame3 | Frame4 |
|---|---|---|---|---|
| GIC1 | 1 | 4 | 1 | 4 |
| GIC2 | 2 | 1 | 2 | 1 |
| GIC3 | 3 | 2 | 3 | 2 |
| GIC4 | 4 | 3 | 4 | 3 |

DISPLAY APPARATUS AND METHOD OF DRIVING THE SAME

This application claims priority to Korean Patent Application No. 10-2017-0167058, filed on Dec. 6, 2017, and all the benefits accruing therefrom under 35 U.S.C. § 119, the content of which in its entirety is herein incorporated by reference.

BACKGROUND

1. Field

Exemplary embodiments of the invention relate to a display apparatus and a method of driving the display apparatus. More particularly, exemplary embodiments of the invention relate to a display apparatus having different output sequences of gate signals in adjacent frames to enhance a display quality and a method of driving the display apparatus.

2. Description of the Related Art

Generally, a display apparatus includes a display panel, a display panel driver and a backlight assembly.

The display panel typically includes a plurality of gate lines, a plurality of data lines and a plurality of pixels. The pixel may include a switching element and a pixel electrode.

The display panel driver may include a gate driver for outputting gate signals to the display panel, a data driver for outputting data voltages to the display panel and a timing controller for controlling driving timings of the gate driver and the data driver.

The backlight assembly may be disposed under the display panel and provide light to the display panel.

SUMMARY

In a display panel, the switching element turned on by the gate signal when the light is provided to the display panel has enhanced current characteristics compared to the switching element turned on by the gate signal when the light is not provided to the display panel. Accordingly, the pixel including the switching element turned on by the gate signal when the light is provided to the display panel has a luminance greater than a luminance of the pixel including the switching element turned on by the gate signal when the light is not provided to the display panel. Due to the luminance difference according to positions in the display panel, the display quality of the display panel may be deteriorated.

Exemplary embodiments of the invention relate to a display apparatus in which output sequences of gate signals are different from each other in adjacent frames to enhance a display quality.

Exemplary embodiments of the invention also relate to a method of driving the display apparatus.

In an exemplary embodiment according to the invention, a display apparatus includes a display panel, a gate driver, a data driver and a backlight assembly. In such an embodiment, the display panel includes a plurality of display blocks. In such an embodiment, the gate driver outputs a gate signal to the display panel. In such an embodiment, the data driver outputs a data voltage to the display panel. In such an embodiment, the backlight assembly provides light to the display panel. In such an embodiment, sequences of outputting the gate signals from the gate driver to the display blocks are different from each other in adjacent frames.

In an exemplary embodiment, the display block may be in a first state when the backlight assembly provides the light to the display block and the gate signal is outputted to the display block. In such an embodiment, the display block may be in a second state when the backlight assembly does not provide the light to the display block and the gate signal is outputted to the display block. In such an embodiment, when the first state and the second state of the display blocks represent a periodicity, the sequences of outputting the gate signals from the gate driver to the display blocks may be different from each other in the adjacent frames.

In an exemplary embodiment, when accumulated numbers of the second state of the display blocks are different from each other during a predetermined accumulation duration, the sequences of outputting the gate signals from the gate driver to the display blocks may be different from each other in the adjacent frames.

In an exemplary embodiment, the gate driver may receive a plurality of converted vertical start signals corresponding to the display blocks, and sequences of activation of the converted vertical start signals may be different from each other in the adjacent frames.

In an exemplary embodiment, the display apparatus may further include a gate turn on controller including: a flipflop part including a plurality of flipflops; and a register part including a plurality of registers. In such an embodiment, the flipflops may generate a sampling signal by sampling a driving signal of the backlight assembly using a plurality of vertical start signals, and the registers may store the sampling signal.

In an exemplary embodiment, the gate turn on controller may further include: a switch part including a plurality of switches connected between the plurality of flipflops and the plurality of registers; and a decoder which controls operations of the switches of the switch part.

In an exemplary embodiment, the display apparatus may include four display blocks, and the flipflop part may include first and second flipflops connected to each other in series, third and fourth flipflops connected to each other in series, fifth and sixth flipflops connected to each other in series and seventh and eighth flipflops connected to each other in series. In such an embodiment, a first vertical start signal corresponding to a first display block of the four display blocks may be applied to the first flipflop and the first vertical start signal may be applied to the second flipflop. In such an embodiment, a second vertical start signal corresponding to a second display block of the four display blocks may be applied to the third flipflop and the first vertical start signal may be applied to the fourth flipflop. In such an embodiment, a third vertical start signal corresponding to a third display block of the four display blocks may be applied to the fifth flipflop and the first vertical start signal may be applied to the sixth flipflop. In such an embodiment, a fourth vertical start signal corresponding to a fourth display block of the four display blocks may be applied to the seventh flipflop and the first vertical start signal may be applied to the eighth flipflop.

In an exemplary embodiment, the display panel may include four display blocks, and the register part may include: a first register connected to the second, fourth, sixth and eighth flipflops to store a first sampling signal of four bits, which is outputted from the second, fourth, sixth and eighth flipflops during a first duration; a second register connected to the second, fourth, sixth and eighth flipflops to store a second sampling signal of four bits which is outputted from the second, fourth, sixth and eighth flipflops during a second duration; a third register connected to the second, fourth, sixth and eighth flipflops to store a third sampling signal of four bits which is outputted from the second, fourth, sixth and eighth flipflops during a third duration; and a fourth register connected to the second, fourth, sixth and eighth flipflops to store a fourth sampling signal of four bits which is outputted from the second, fourth, sixth and eighth flipflops during a fourth duration.

In an exemplary embodiment, the display panel may include four display blocks, the decoder may generate a control signal of four bits to control the switches connected between the second, fourth, sixth and eighth flipflops and the first to fourth registers based on control bits of two bits.

In an exemplary embodiment, the display apparatus may further include a vertical start signal controller which generates the converted vertical start signal based on the sampling signal.

In an exemplary embodiment, when the sampling signal corresponding to the display blocks represents a periodicity, the vertical start signal may generate the converted vertical start signal.

In an exemplary embodiment, the sampling signal may have a first level and a second level. In such an embodiment, when accumulated numbers of the second levels of the sampling signals corresponding to the display blocks are different from each other during a predetermined accumulation duration, the vertical start signal controller may generate the converted vertical start signals.

In an exemplary embodiment according to the invention, a method of driving a display apparatus includes outputting a gate signal to plurality of display blocks of a display panel of the display apparatus, outputting a data voltage to the display panel and providing light to the display panel. In such an embodiment, sequences of outputting the gate signals to the display blocks are different from each other in adjacent frames.

In an exemplary embodiment, the display block may be in a first state when the light is provided to the display block and the gate signal is outputted to the display block, and the display block may be in a second state when the light is not provided to the display block and the gate signal is outputted to the display block. In such an embodiment, when the first state and the second state of the display blocks represent a periodicity, the sequences of outputting the gate signals to the display blocks may be different from each other in the adjacent frames.

In an exemplary embodiment, when accumulated numbers of the second state of the display blocks are different from each other during a predetermined accumulation duration, the sequences of outputting the gate signals to the display blocks may be different from each other in the adjacent frames.

In an exemplary embodiment, a gate driver of the display device, which outputs the gate signal to the display panel, may receive a plurality of converted vertical start signals corresponding to the display blocks. In such an embodiment, sequences of activation of the converted vertical start signals may be different from each other in the adjacent frames.

In an exemplary embodiment, the method may further include: generating a sampling signal by sampling a driving signal of a backlight assembly of the display device, which provides the light to the display panel, using a plurality of vertical start signals from a plurality of flipflops; and storing the sampling signal to a plurality of registers.

In an exemplary embodiment, the method may further include controlling turning on and off of a plurality of switches connected between the flipflops and the registers.

In an exemplary embodiment, the method may further include generating the converted vertical start signals based on the sampling signal stored in the registers.

According to exemplary embodiments of the display apparatus and the method of driving the display apparatus, the display panel may be divided into a plurality of display blocks and sequences of outputting the gate signals to the display blocks may be different from each other in adjacent frames. Accordingly, in such embodiments, synchronization of a cycle of turning on and off the backlight assembly and a driving cycle of the display blocks may be effectively prevented and a waterfall defect generated by differences between the switching elements of the display panel may be effectively prevented. Thus, in such embodiments, the display quality of the display panel may be enhanced.

BRIEF DESCRIPTION OF THE DRAWINGS

The above and other features of the invention will become more apparent by describing in detailed exemplary embodiments thereof with reference to the accompanying drawings, in which:

FIG. 10 is a table illustrating values stored in a register of FIG. 5 according to the input and output signals of FIG. 9;

FIGS. 14 and 15 are a signal timing diagram and a table illustrating an exemplary driving sequence of the blocks of the gate driver of FIG. 13;

FIGS. 16 and 17 are a signal timing diagram and a table illustrating an exemplary driving sequence of the blocks of the gate driver of FIG. 13;

FIGS. 18 and 19 are a signal timing diagram and a table illustrating an exemplary driving sequence of the blocks of the gate driver of FIG. 13; and FIGS. 20 and 21 are a signal timing diagram and a table illustrating an exemplary driving sequence of the blocks of the gate driver of FIG. 13.

DETAILED DESCRIPTION

Figure 1:
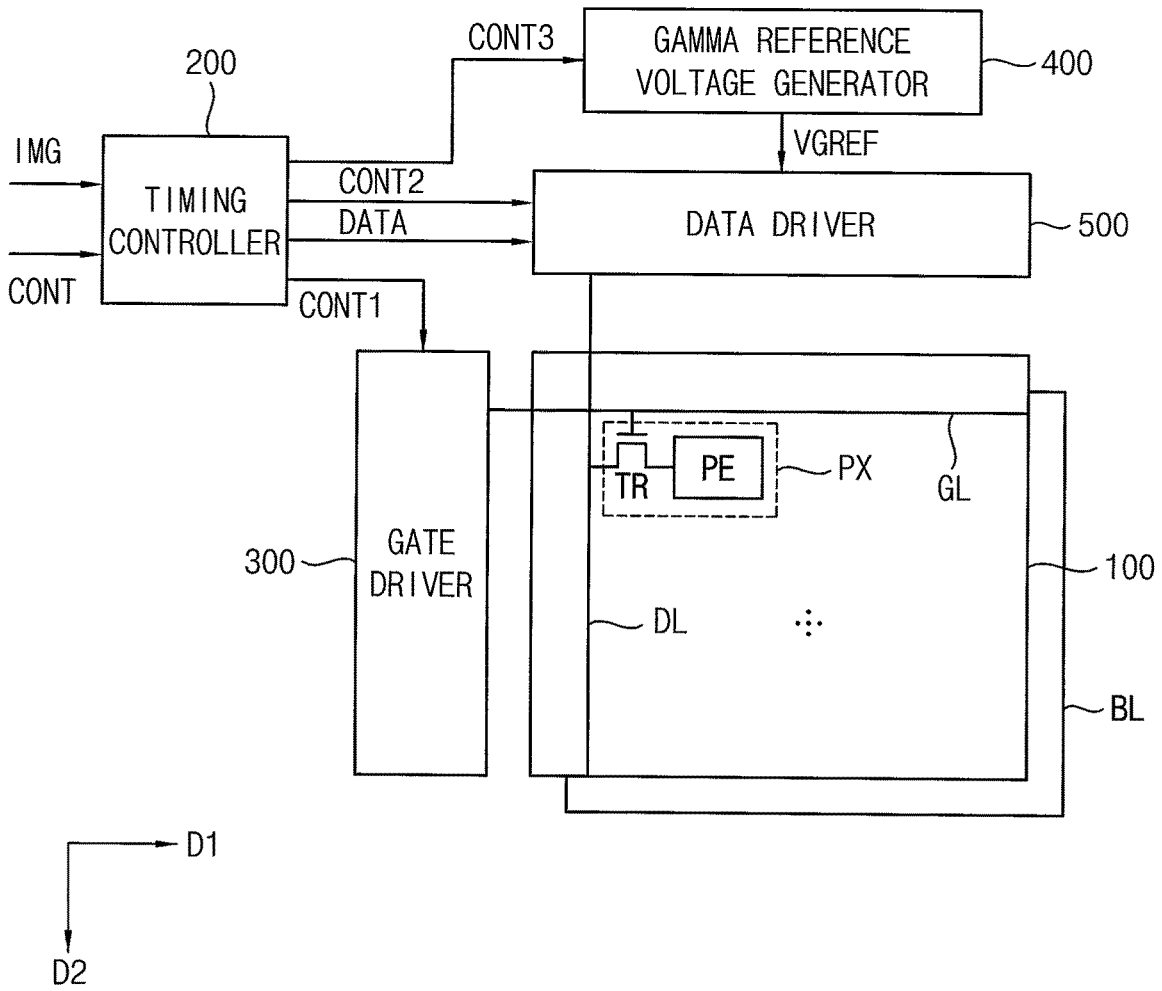
FIG. 1 is a block diagram illustrating a display apparatus according to an exemplary embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system).

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

FIG. 1 is a block diagram illustrating a display apparatus according to an exemplary embodiment of the invention.

Referring to FIG. 1, an exemplary embodiment of the display apparatus includes a display panel 100, a display panel driver and a backlight assembly BL. The display panel driver includes a timing controller 200, a gate driver 300, a gamma reference voltage generator 400 and a data driver 500.

In such an embodiment, the display panel 100 includes a plurality of gate lines GL, a plurality of data lines DL, and a plurality of pixels PX electrically connected to the gate lines GL and the data lines DL. The gate lines GL extend in a first direction D1, and the data lines DL extend in a second direction D2 crossing the first direction D1.

Each pixel PX includes a switching element TR and a pixel electrode PE electrically connected to the switching element TR. The pixels PX may be disposed in a matrix form.

The display panel 100 includes a plurality of display blocks. The display blocks may extend in a direction parallel to the extending direction of the gate lines GL. The display blocks may be disposed in a direction perpendicular to the extending direction of the gate lines GL.

The structures of the display panel 100 will be described later in greater detail referring to FIGS. 3A, 3B and 4.

In such an embodiment, the timing controller 200 receives input image data IMG and an input control signal CONT from an external apparatus (not shown). The input image data IMG may include red image data, green image data and blue image data. The input control signal CONT may include a master clock signal and a data enable signal. The input control signal CONT may further include a vertical synchronizing signal and a horizontal synchronizing signal.

The timing controller 200 generates a first control signal CONT1, a second control signal CONT2, a third control signal CONT3 and a data signal DATA, based on the input image data IMG and the input control signal CONT.

The timing controller 200 generates the first control signal CONT1 for controlling an operation of the gate driver 300 based on the input control signal CONT, and outputs the first control signal CONT1 to the gate driver 300. The first control signal CONT1 may include a vertical start signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data IMG. The timing controller 200 outputs the data signal DATA to the data driver 500.

The timing controller 200 generates the third control signal CONT3 for controlling an operation of the gamma reference voltage generator 400 based on the input control signal CONT, and outputs the third control signal CONT3 to the gamma reference voltage generator 400.

In such an embodiment, the gate driver 300 generates gate signals for driving the gate lines GL in response to the first control signal CONT1 received from the timing controller 200. The gate driver 300 outputs the gate signals to the gate lines GL.

In such an embodiment, the gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 may be disposed in the timing controller 200, or in the data driver 500.

In an exemplary embodiment, the data driver 500 receives the second control signal CONT2 and the data signal DATA from the timing controller 200, and receives the gamma reference voltages VGREF from the gamma reference voltage generator 400. The data driver 500 converts the data signal DATA into data voltages of an analog type using the gamma reference voltages VGREF. The data driver 500 outputs the data voltages to the data lines DL.

In such an embodiment, the backlight assembly BL is disposed under the display panel 100, and provides light to the display panel 100. The backlight assembly BL may include a plurality of light sources.

In an exemplary embodiment, the display apparatus further includes a gate turn on controller and a vertical start signal controller to output the gate signals in different sequences to the display blocks in adjacent frames. The operations and the structures of the gate turn on controller and the vertical start signal controller will be described later in greater detail referring to FIGS. 5 to 7.

Figure 2A:
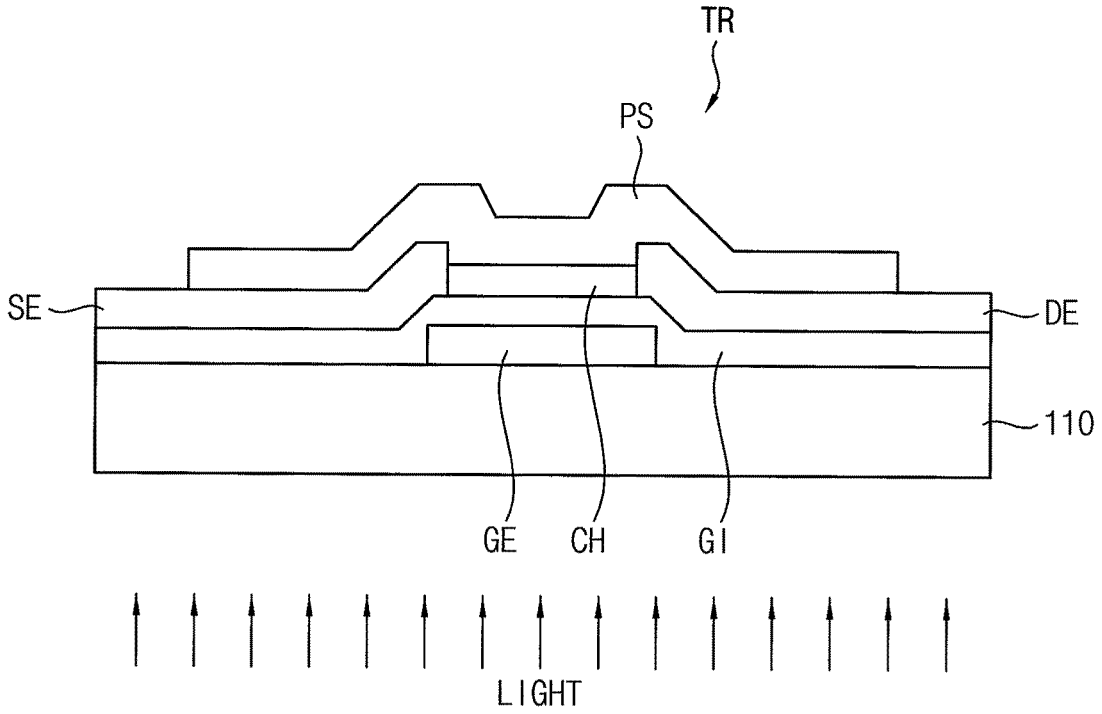
FIG. 2A is a cross sectional view illustrating an exemplary embodiment of a switching element of FIG. 1.
Figure 2B:
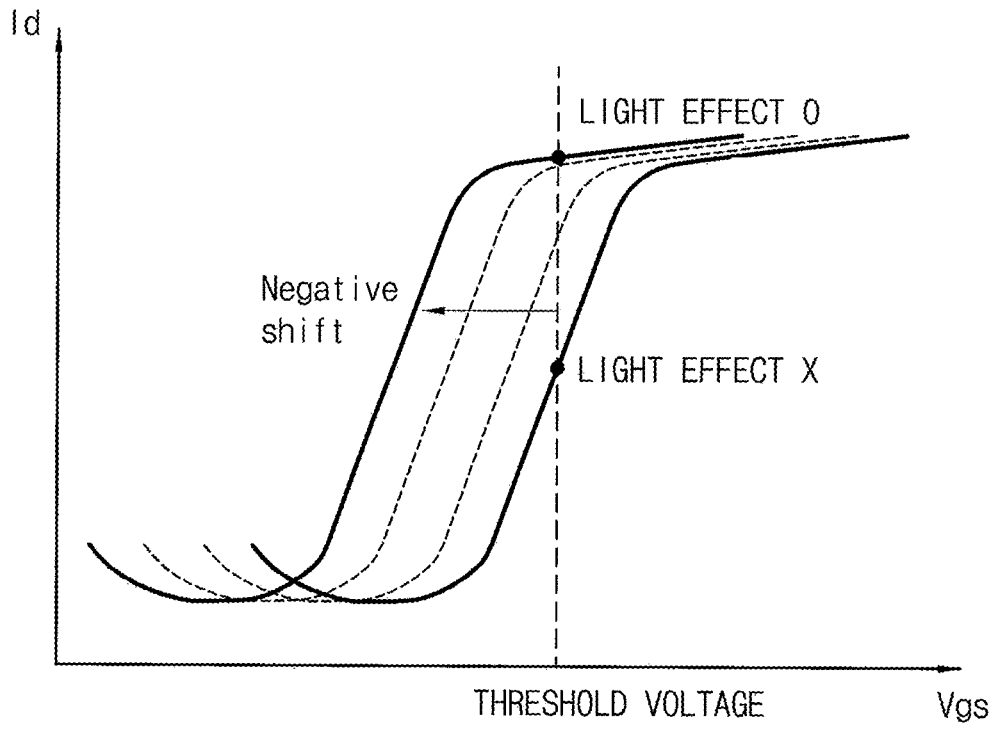
FIG. 2B is a graph illustrating a voltage shift of the switching element of FIG. 1 generated by the light provided from the backlight assembly.

FIG. 2A is a cross sectional view illustrating an exemplary embodiment of a switching element TR of FIG. 1. FIG. 2B is a graph illustrating a voltage shift of the switching element TR of FIG. 1 generated by the light provided from the backlight assembly BL.

Referring to FIGS. 1, 2A and 2B, the switching element TR of the pixel PX may include a gate electrode GE disposed on a base substrate 110, a gate insulating layer GI disposed on the gate electrode GE, a source electrode SE disposed on the gate insulating layer GI, a drain electrode DE spaced apart from the source electrode SE, a channel layer CH, which is disposed on the gate electrode GE, disposed between the source electrode SE and the drain electrode DE and includes a semiconductor, and a passivation layer PS disposed on the channel layer CH.

When the light from the backlight assembly BL is irradiated to the switching element TR, electrons and holes in the channel layer CH are divided such that carriers of the channel layer CH increases.

When the carriers of the channel layer CH increases by the light from the backlight assembly BL, a threshold voltage of the switching element TR decrease such that a current-voltage curve of the switching element TR is negatively shifted as shown in FIG. 2B.

When the current-voltage curve of the switching element TR is negatively shifted by the light from the backlight assembly BL, a drain current Id of the switching element TR according to a gate-source voltage Vgs increase such that a current characteristics of the switching element TR is enhanced.

Thus, when a same voltage is applied to the switching elements TR, the pixel PX including the switching element TR, to which the light is provided from the backlight assembly BL, has a luminance greater than a luminance of the pixel PX including the switching element TR, to which the light is not provided from the backlight assembly BL.

Figure 3A:
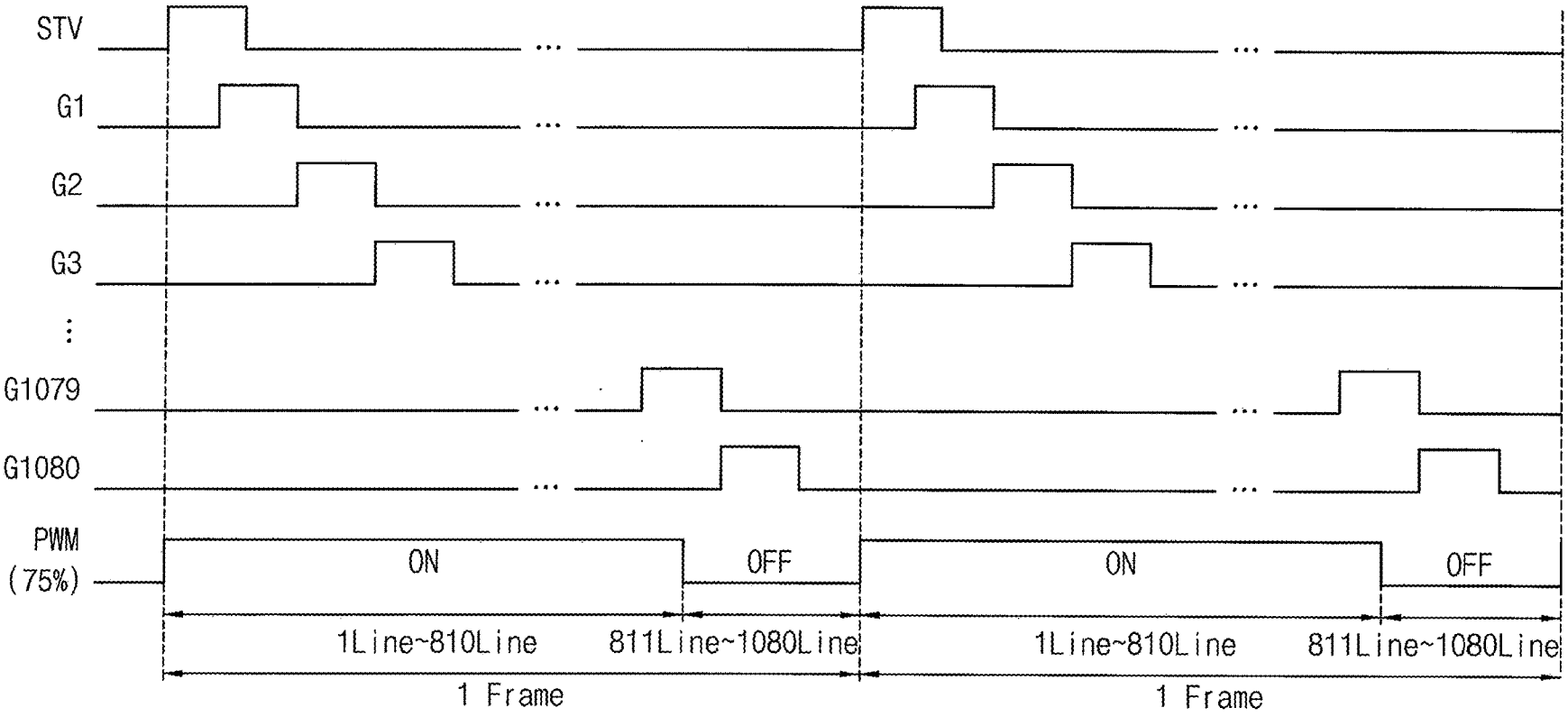
FIGS. 3A and 3B are conceptual diagrams illustrating a gate block noise of a display panel when a duty ratio of the backlight assembly of FIG. 1.
Figure 3B:
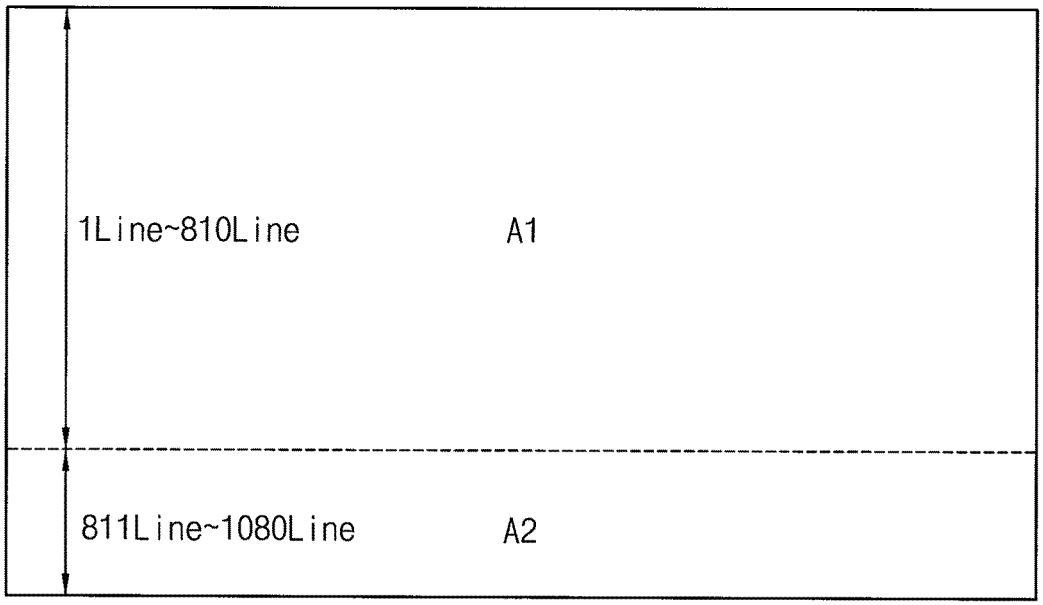

FIGS. 3A and 3B are conceptual diagrams illustrating a gate block noise of the display panel 100 when a duty ratio of the backlight assembly BL of FIG. 1.

Referring to FIGS. 1 to 3B, in an exemplary embodiment, the gate signal may be sequentially scanned in an entire area of the display panel 100 during a single frame 1 Frame. In one exemplary embodiment, for example, where the display panel 100 includes 1080 gate lines, the gate driver 300 may sequentially output first to $1080^{th}$ gate signals G1 to G1080 to first to 1080th gate lines in response to a vertical start signal STV.

In an exemplary embodiment, as shown in FIG. 3A, the backlight assembly BL may be driven in a dimming driving method. In one exemplary embodiment, for example, the backlight assembly BL may be driven in a duty ratio of about 75%. The driving signal of the backlight assembly BL may be a pulse width modulation ("PWM") signal. A cycle of the dimming driving of the backlight assembly BL may be the same as the frame of the display panel 100.

In such an embodiment, where the backlight assembly BL is driven in the duty ratio of 75%, the backlight assembly BL may provide light to the display panel 100 when an upper ¾ area A1 of the display panel 100 is scanned and the backlight assembly BL may not provide light to the display panel 100 when a lower ¼ area A2 of the display panel 100 is scanned.

In one exemplary embodiment, for example, the upper ¾ area A1 of the display panel 100 may correspond to an area where first to 810th gate lines are disposed, and the lower ¼ area A2 of the display panel 100 may correspond to an area where 811th to 1080th gate lines are disposed, as shown in FIG. 3B.

The backlight assembly BL provides light to the display panel 100 when the upper ¾ area A1 of the display panel 100 is scanned and the backlight assembly BL does not provide light to the display panel 100 when the lower ¼ area A2 of the display panel 100 is scanned such that the upper ¾ area A1 of the display panel 100 may have the luminance greater than the luminance of the lower ¼ area A2 of the display panel 100 in the duty ratio of 75% as described above referring to FIGS. 2A and 2B.

If the scanning cycle (1 Frame) of the display panel 100 is the same as the dimming cycle (1 Frame) of the backlight assembly BL, the luminance difference between the areas A1 and A2 of the display panel 100 may be recognized by a user.

Figure 4:
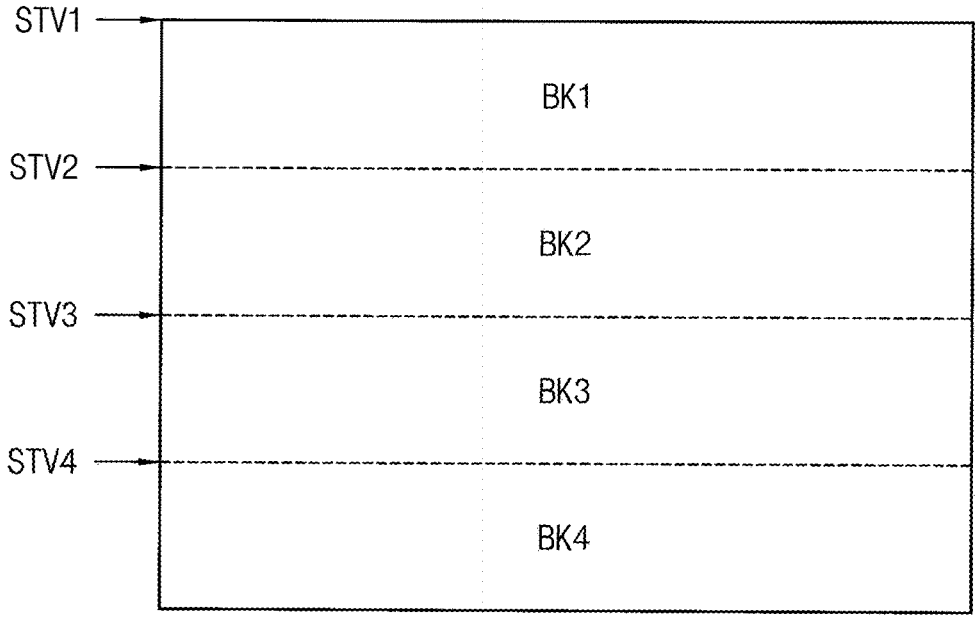
FIG. 4 is a conceptual diagram illustrating a relationship between blocks of the display panel of FIG. 1 and a vertical start signal.
Figure 5:
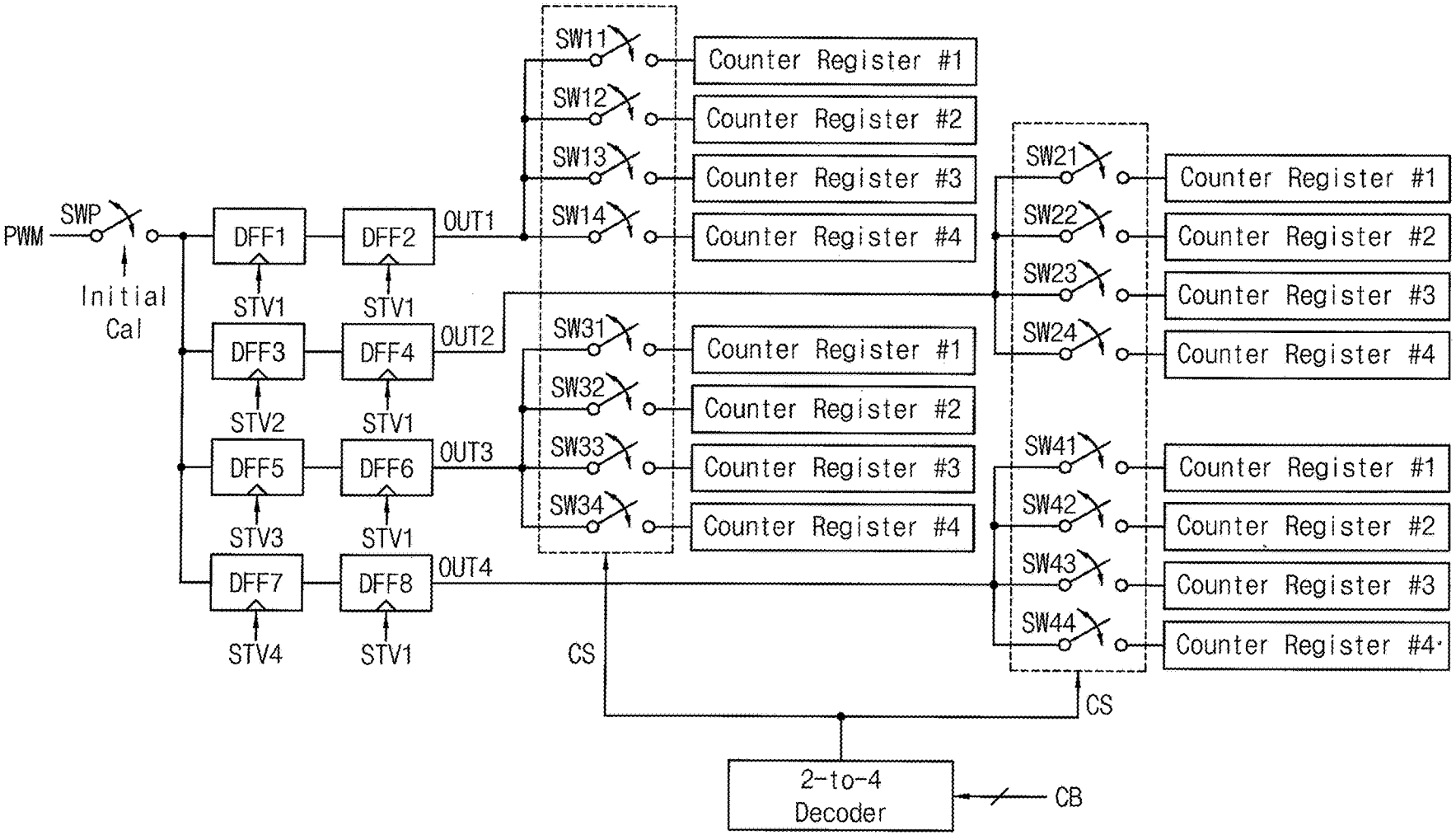
FIG. 5 is a circuit diagram illustrating an exemplary embodiment of a gate turn on controller of the display apparatus of FIG. 1.
Figures 6, 7:
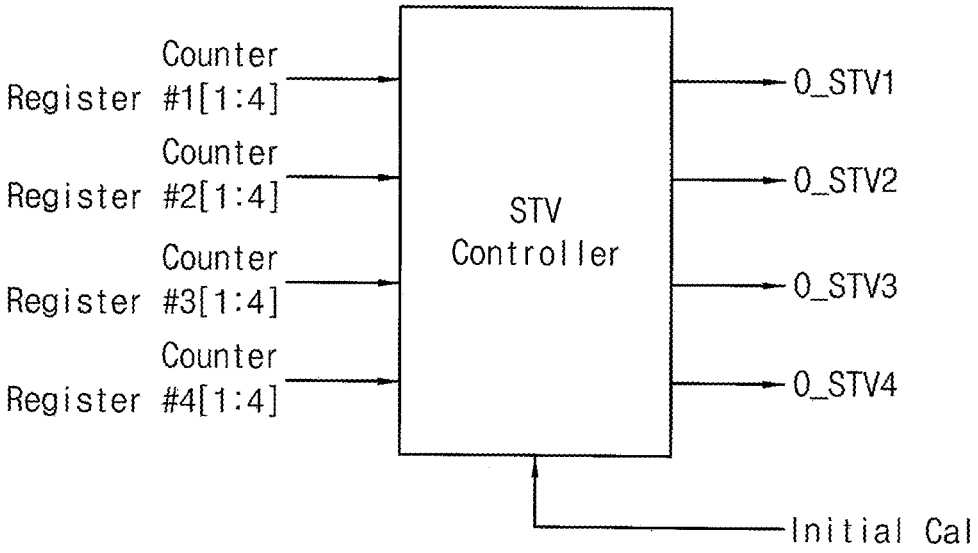
FIG. 6 is a table illustrating input and output signals of a decoder of FIG. 5.
FIG. 7 is a block diagram illustrating an exemplary embodiment of a vertical start signal controller of the display apparatus of FIG. 1.
Figure 8:
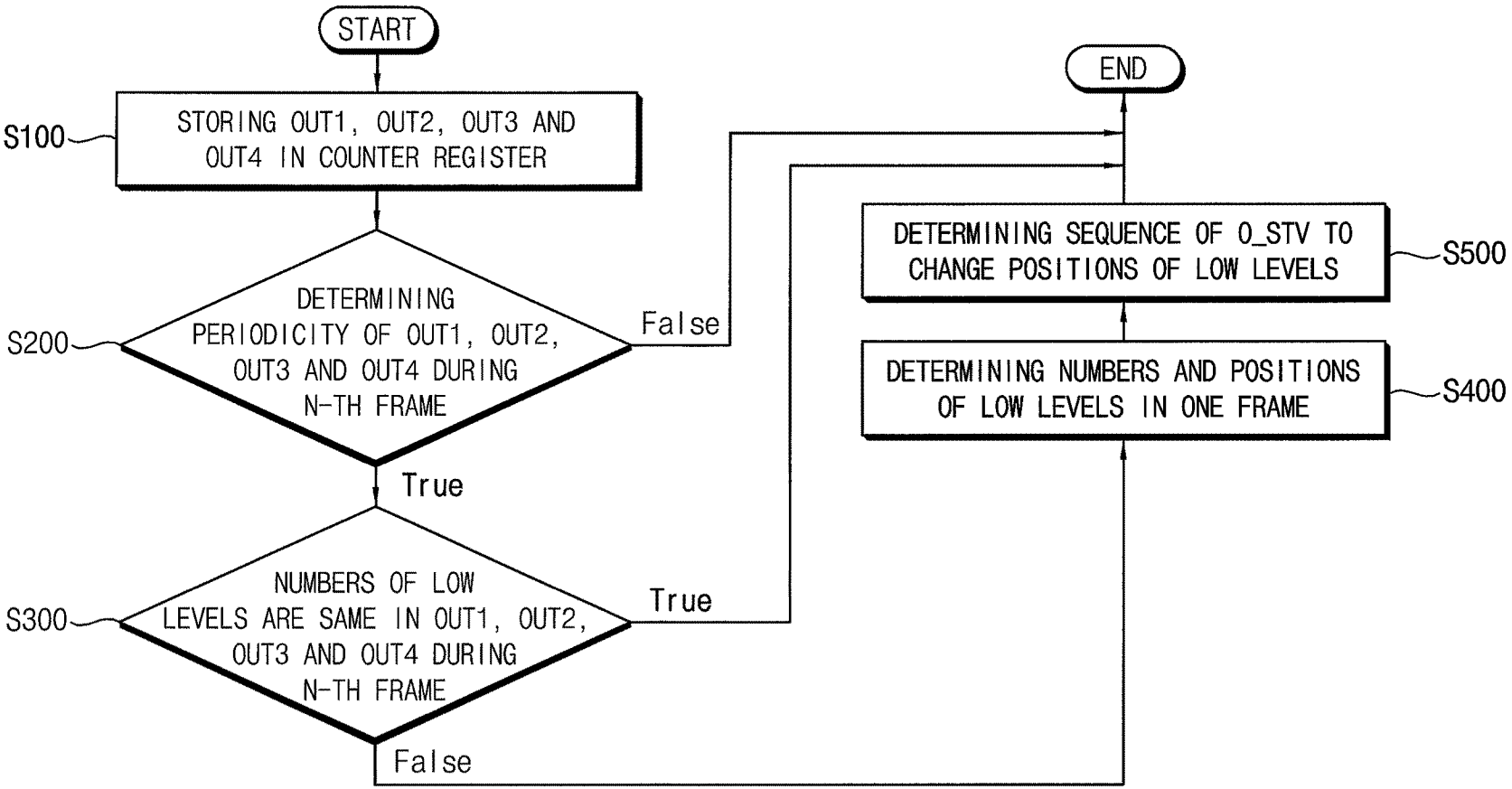
FIG. 8 is a flowchart illustrating operations of the gate turn on controller of FIG. 5 and the vertical start signal controller of FIG. 7.

FIG. 4 is a conceptual diagram illustrating a relationship between blocks of the display panel of FIG. 1 and a vertical start signal. FIG. 5 is a circuit diagram illustrating an exemplary embodiment of a gate turn on controller of the display apparatus of FIG. 1. FIG. 6 is a table illustrating input and output signals of a decoder of FIG. 5. FIG. 7 is a block diagram illustrating an exemplary embodiment of a vertical start signal controller of the display apparatus of FIG. 1. FIG. 8 is a flowchart illustrating operations of the gate turn on controller of FIG. 5 and the vertical start signal controller of FIG. 7.

Referring to FIGS. 1, 4 to 8, an exemplary embodiment of the display panel 100 may include (or be divided into) a plurality of display blocks BK1, BK2, BK3 and BK4. For convenience of illustration and description, FIGS. 4 to 8 show an exemplary embodiment where the display panel 100 includes four display blocks, but the invention is not limited thereto.

In an exemplary embodiment, the number of the vertical start signal may correspond to the number of the display blocks. In one exemplary embodiment, for example, a first display block BK1 of the display panel 100 may be driven by a first vertical start signal STV1, a second display block BK2 of the display panel 100 may be driven by a second vertical start signal STV2, a third display block BK3 of the display panel 100 may be driven by a third vertical start signal STV3 and a fourth display block BK4 of the display panel 100 may be driven by a fourth vertical start signal STV4.

As described above referring to FIGS. 1 to 3B, when the scanning cycle (1 Frame) of the display panel 100 is the same as the dimming cycle (1 Frame) of the backlight assembly BL, the luminance difference between the areas A1 and A2 of the display panel 100 may be recognized by a user. Thus, in an exemplary embodiment, the sequences of outputting (or output sequences of) the gate signals to the display blocks BK1, BK2, BK3 and BK4 may be set different in adjacent frames.

In one exemplary embodiment, for example, the gate driver 300 receives converted vertical start signals O_STV1, O_STV2, O_STV3 and O_STV4 (shown in FIG. 7) which are generated by changing the activation sequences of the vertical start signals STV1, STV2, STV3 and STV4. The gate driver 300 may change the driving sequences of the display blocks BK1, BK2, BK3 and BK4 based on the converted vertical start signals O_STV1, O_STV2, O_STV3 and O_STV4.

When the backlight assembly BL provides light to the display block and the gate signal is outputted to the display block, the display block is in a first state. When the backlight assembly BL does not provide light to the display block and the gate signal is outputted to the display block, the display block is in a second state. The first state may mean a high luminance state in which the pixels in the display block corresponding to the gate signals represent relatively high luminances. The second state may mean a low luminance state in which the pixels in the display block corresponding to the gate signals represent relatively low luminances.

In an exemplary embodiment, when the first state and the second state of the display blocks BK1, BK2, BK3 and BK4 represent a periodicity (e.g., when first state and the second state of the display blocks BK1, BK2, BK3 and BK4 are repeated), the sequences of outputting the gate signals to the display blocks BK1, BK2, BK3 and BK4 may be different from each other in adjacent frames. When the first state and the second state of the display blocks BK1, BK2, BK3 and BK4 do not represent the periodicity, the sequence of driving the display blocks BK1, BK2, BK3 and BK4 may not be adjusted such that the display blocks BK1, BK2, BK3 and BK4 may be sequentially driven in a vertical direction.

In such an embodiment, when the accumulated numbers of the second state of the display blocks BK1, BK2, BK3 and BK4 are different from each other in a preset duration, the sequences of outputting the gate signals to the display blocks BK1, BK2, BK3 and BK4 may be different from each other in adjacent frames. If the accumulated numbers of the second state of the display blocks BK1, BK2, BK3 and BK4 are the same as each other in the preset duration although the first state and the second state of the display blocks BK1, BK2, BK3 and BK4 represent the periodicity, the luminances of the display blocks BK1, BK2, BK3 and BK4 in the preset duration may be the same as each other. Thus, when the accumulated numbers of the second state of the display blocks BK1, BK2, BK3 and BK4 are the same as each other in the preset duration, the driving sequences of the display blocks BK1, BK2, BK3 and BK4 may not be changed such that the display blocks BK1, BK2, BK3 and BK4 may be sequentially driven in a vertical direction.

In an exemplary embodiment, the gate driver 300 may receive the converted vertical start signals O_STV1, O_STV2, O_STV3 and O_STV4 corresponding to the display blocks BK1, BK2, BK3 and BK4 to adjust the sequence of outputting the gate signals to the display blocks BK1, BK2, BK3 and BK4. The gate driver 300 may output the gate signals to the display blocks BK1, BK2, BK3 and BK4 according to the sequences of activation of the converted vertical start signals O_STV1, O_STV2, O_STV3 and O_STV4.

The gate turn on controller may sample the driving signal PWM of the backlight assembly BL based on the vertical start signals STV1, STV2, STV3 and STV4 to generate sampling signals OUT1, OUT2, OUT3 and OUT4.

The vertical start signal controller may generate the converted vertical start signals O_STV1, O_STV2, O_STV3 and O_STV4 based on the sampling signals OUT1, OUT2, OUT3 and OUT4.

The gate driver 300 may adjust the driving sequences of the display blocks BK1, BK2, BK3 and BK4 based on the converted vertical start signals O_STV1, O_STV2, O_STV3 and O_STV4.

In one exemplary embodiment, for example, the gate turn on controller and the vertical start signal controller may be disposed in the timing controller 200. Alternatively, the gate turn on controller and the vertical start signal controller may be disposed in the gate driver 300. Alternatively the gate turn on controller and the vertical start signal controller may be formed independently from the timing controller 200 and the gate driver 300.

In an exemplary embodiment, as shown in FIG. 5, the gate turn on controller may include a flipflop part including a plurality of flipflops DFF1, DFF2, DFF3, DFF4, DFF5, DFF6, DFF7 and DFF8 for sampling the driving signal PWM using the vertical start signals STV1, STV2, STV3 and STV4 to generate the sampling signals OUT1, OUT2, OUT3 and OUT4, a register part including a plurality of registers Counter Register #1, Counter Register #2, Counter Register #3 and Counter Register #4 for storing the sampling signals OUT1, OUT2, OUT3 and OUT4.

The gate turn on controller may further include a switch part and a decoder (e.g. 2-to-4 Decoder). The switch part may include a plurality of switches SW11 to SW14, SW21 to SW24, SW31 to SW34 and SW41 to SW44 connected between the flipflops DFF1, DFF2, DFF3, DFF4, DFF5, DFF6, DFF7 and DFF8 and the registers Counter Register #1, Counter Register #2, Counter Register #3 and Counter Register #4. The decoder may control turn-on operations of the switches SW11 to SW14, SW21 to SW24, SW31 to SW34 and SW41 to SW44 of the switch part.

In an exemplary embodiment, where the display panel 100 includes four display blocks BK1, BK2, BK3 and BK4, the flipflop part may include first and second flipflops DFF1 and DFF2 connected to each other in series, third and fourth flipflops DFF3 and DFF4 connected to each other in series, fifth and sixth flipflops DFF5 and DFF6 connected to each other in series, and seventh and eighth flipflops DFF7 and DFF8 connected to each other in series, as shown in FIG. 5.

The first vertical start signal STV1 corresponding to the first display block BK1 may be applied to the first flipflop DFF1, and the first vertical start signal STV1 may be applied to the second flipflop DFF2.

The second vertical start signal STV2 corresponding to the second display block BK2 may be applied to the third flipflop DFF3, and the first vertical start signal STV1 may be applied to the fourth flipflop DFF4.

The third vertical start signal STV3 corresponding to the third display block BK3 may be applied to the fifth flipflop DFF5, and the first vertical start signal STV1 may be applied to the sixth flipflop DFF6.

The fourth vertical start signal STV4 corresponding to the fourth display block BK4 may be applied to the seventh flipflop DFF7, and the first vertical start signal STV1 may be applied to the eighth flipflop DFF8.

The registers may include a first register Counter Register #1, a second register Counter Register #2, a third register Counter Register #3 and a fourth register Counter Register #4. The first register Counter Register #1 may be connected to the second, fourth, sixth and eighth flipflops DFF2, DFF4, DFF6 and DFF8, and may store a first sampling signal of four bits (OUT1[FIRST DURATION], OUT2[FIRST DURATION], OUT3[FIRST DURATION] and OUT4[FIRST DURATION]) outputted from the second, fourth, sixth and eighth flipflops DFF2, DFF4, DFF6 and DFF8 during a first duration. The second register Counter Register #2 may be connected to the second, fourth, sixth and eighth flipflops DFF2, DFF4, DFF6 and DFF8, and may store a second sampling signal of four bits (OUT1 [SECOND DURATION], OUT2[SECOND DURATION], OUT3[SECOND DURATION] and OUT4[SECOND DURATION]) outputted from the second, fourth, sixth and eighth flipflops DFF2, DFF4, DFF6 and DFF8 during a second duration. The third register Counter Register #3 may be connected to the second, fourth, sixth and eighth flipflops DFF2, DFF4, DFF6 and DFF8, and may store a third sampling signal of four bits (OUT1[THIRD DURATION], OUT2[THIRD DURATION], OUT3[THIRD DURATION] and OUT4[THIRD DURATION]) outputted from the second, fourth, sixth and eighth flipflops DFF2, DFF4, DFF6 and DFF8 during a third duration. The fourth register Counter Register #4 may be connected to the second, fourth, sixth and eighth flipflops DFF2, DFF4, DFF6 and DFF8, and may store a fourth sampling signal of four bits (OUT1[FOURTH DURATION], OUT2[FOURTH DURATION], OUT3[FOURTH DURATION] and OUT4[FOURTH DURATION]) outputted from the second, fourth, sixth and eighth flipflops DFF2, DFF4, DFF6 and DFF8 during a fourth duration.

The switch part may include four switches SW11, SW12, SW13 and SW14 connected to the second flipflop DFF2, four switches SW21, SW22, SW23 and SW24 connected to the fourth flipflop DFF4, four switches SW31, SW32, SW33 and SW34 connected to the sixth flipflop DFF6 and four switches SW41, SW42, SW43 and SW44 connected to the eighth flipflop DFF8.

The decoder 2-to-4 Decoder may generate a control signal of four bits for controlling the switches SW11 to SW14, SW21 to SW24, SW31 to SW34 and SW41 to SW44, which are connected between the second, fourth, sixth and eighth flipflops DFF2, DFF4, DFF6 and DFF8 and the first to fourth registers Counter Register #1, Counter Register #2, Counter Register #3 and Counter Register #4, based on control bits CB of two bits.

In one exemplary embodiment, for example, when the control bits CB are "00", the control signal CS may be "1000", when the control bits CB are "01", the control signal CS may be "0100", when the control bits CB are "10", the control signal CS may be "0010" and when the control bits CB are "00", the control signal CS may be "0001".

During the first duration, the control bits CB are "00", the control signal CS is "1000", the switches SW11, SW21, SW31 and SW41 are turned on and all of the remaining switches are turned off so that the first sampling signal may be stored in the first register Counter Register #1 (S100).

During the second duration, the control bits CB are "01", the control signal CS is "0100", the switches SW12, SW22, SW32 and SW42 are turned on and all of the remaining switches are turned off so that the second sampling signal may be stored in the second register Counter Register #2 (S100).

During the third duration, the control bits CB are "10", the control signal CS is "0010", the switches SW13, SW23, SW33 and SW43 are turned on and all of the remaining switches are turned off so that the third sampling signal may be stored in the third register Counter Register #3 (S100).

During the fourth duration, the control bits CB are "11", the control signal CS is "0001", the switches SW14, SW24, SW34 and SW44 are turned on and all of the remaining switches are turned off so that the fourth sampling signal may be stored in the fourth register Counter Register #4 (S100).

The gate turn on controller may further include a sampling switch SWP to selectively provide the driving signal PWM of the backlight assembly BL to the first, third, fifth and seventh flipflops DFF1, DFF3, DFF5 and DFF7.

When an activated enable signal Initial Cal is applied to the sampling switch SWP, the sampling switch SWP is turned on such that the driving signal PWM of the backlight assembly BL is provided to the first, third, fifth and seventh flipflops DFF1, DFF3, DFF5 and DFF7. The enable signal Initial Cal is a signal enabling the gate turn on controller. When the enable signal Initial Cal is inactivated, the gate turn on controller may not operate. In one exemplary embodiment, for example, the enable signal Initial Cal may be activated in an initial time of the driving of the gate driver 300 to determine the periodicity of the sampling signal and the accumulated numbers of the second state of the sampling signal.

The vertical start signal controller (STV controller in FIG. 7) generates the converted vertical start signals O_STV1, O_STV2, O_STV3 and O_STV4 based on the sampling signals stored in the registers Counter Register #1, Counter Register #2, Counter Register #3 and Counter Register #4.

The vertical start signal controller may operate only when the activated enable signal Initial Cal is applied.

The vertical start signal controller may generate the converted vertical start signals O_STV1, O_STV2, O_STV3 and O_STV4 when the sampling signals corresponding to the display blocks BK1, BK2, BK3 and BK4 represent the periodicity (S200). The vertical start signal controller may determine the periodicity of the sampling signal during N frames. In an exemplary embodiment, where the display panel 100 includes four display blocks, the vertical start signal controller may determine the periodicity of the sampling signal during four frames.

The sampling signal may include a first level (e.g. HIGH) and a second level (e.g. LOW).

In an exemplary embodiment, when the accumulated numbers of the second level LOW of the sampling signals corresponding to the display blocks are different from each other during a preset duration, the vertical start signal controller may generate the converted vertical start signals O_STV1, O_STV2, O_STV3 and O_STV4 (S300). The vertical start signal controller may compare the accumulated numbers of the second level LOW of the sampling signals during N frames. In an exemplary embodiment, where the display panel 100 includes four display blocks, the vertical start signal controller may compare the accumulated numbers of the second level LOW of the sampling signals during four frames.

The vertical start signal controller may determine the numbers of the second levels LOW and the positions of the second levels LOW in one frame (S400).

The vertical start signal controller may determine the converted vertical start signals O_STV1, O_STV2, O_STV3 and O_STV4 (e.g., a sequence thereof) in a way such that the positions of the second levels LOW of the sampling signals of the second, fourth, sixth and eighth flipflops DFF2, DFF4, DFF6 and DFF8 may be continuously changed (S500).

Figure 9:
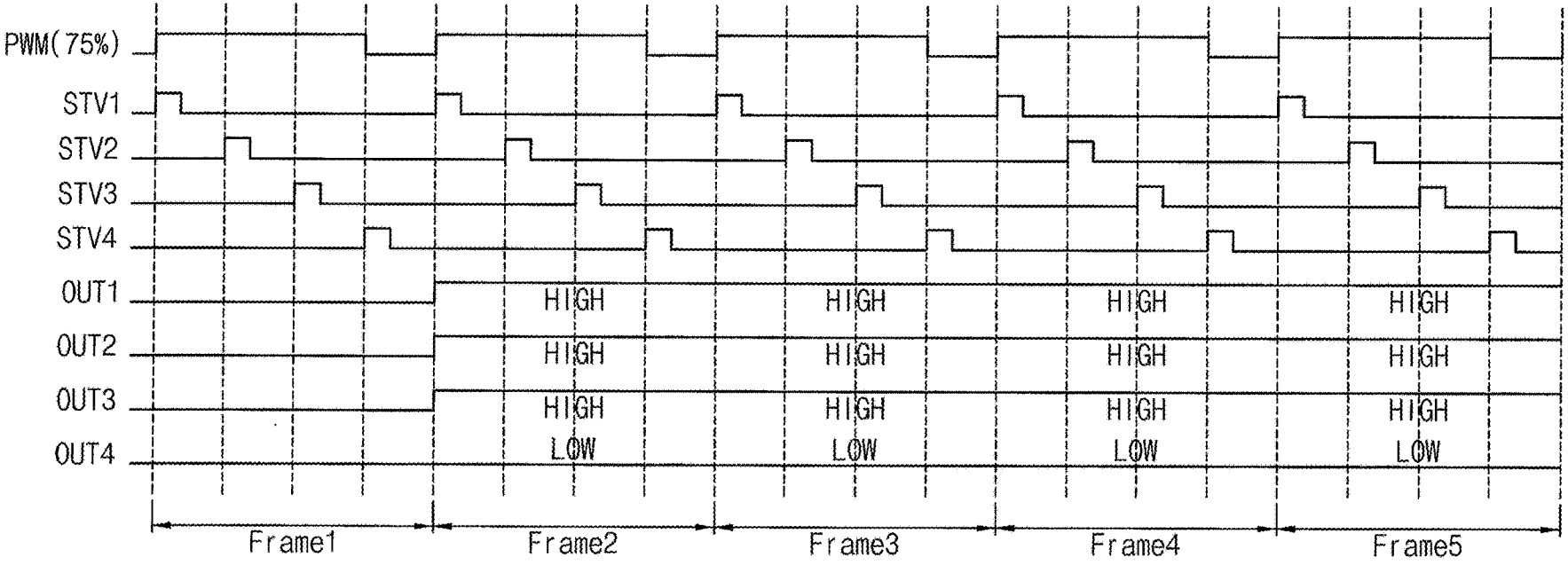
FIG. 9 is a signal timing diagram illustrating exemplary input and output signals of the gate turn on controller of FIG. 5.

FIG. 9 is a timing signal diagram illustrating exemplary input and output signals of the gate turn on controller of FIG. 5. FIG. 10 is a table illustrating values stored in a register of FIG. 5 according to the input and output signals of FIG. 9.

In an exemplary embodiment, as shown in FIGS. 9 and 10, the scanning cycle (Frame) of the gate signal may be the same as the cycle of the driving signal PWM of the backlight assembly BL. In such an embodiment, the duty ratio of the driving signal PWM of the backlight assembly BL may be about 75%.

Referring to FIGS. 1, 4 to 10, for example, the gate turn on controller and the vertical start signal controller may be initialized during a first frame Frame1.

During a second frame Frame2, a first sampling signal of HIGH, HIGH, HIGH and LOW is stored in the first register Counter Register #1. During a third frame Frame3, a second sampling signal of HIGH, HIGH, HIGH and LOW is stored in the second register Counter Register #2. During a fourth frame Frame4, a third sampling signal of HIGH, HIGH, HIGH and LOW is stored in the third register Counter Register #3. During a fifth frame Frame5, a fourth sampling signal of HIGH, HIGH, HIGH and LOW is stored in the fourth register Counter Register #4.

In such an embodiment, the vertical start signal controller determines that the sampling signals represent the periodicity during four frames Frame2 to Frame 5. In such an embodiment, the vertical start signal controller respectively determines the accumulated numbers of the second levels LOW as 0, 0, 0 and 4.

In an exemplary embodiment, the sampling signals represent the periodicity and the accumulated numbers of the second levels of the sampling signals are different from each other during the preset duration (e.g. Frame2 to Frame5) such that the sequences of outputting the gate signals may be differently set in adjacent frames.

Figure 11:
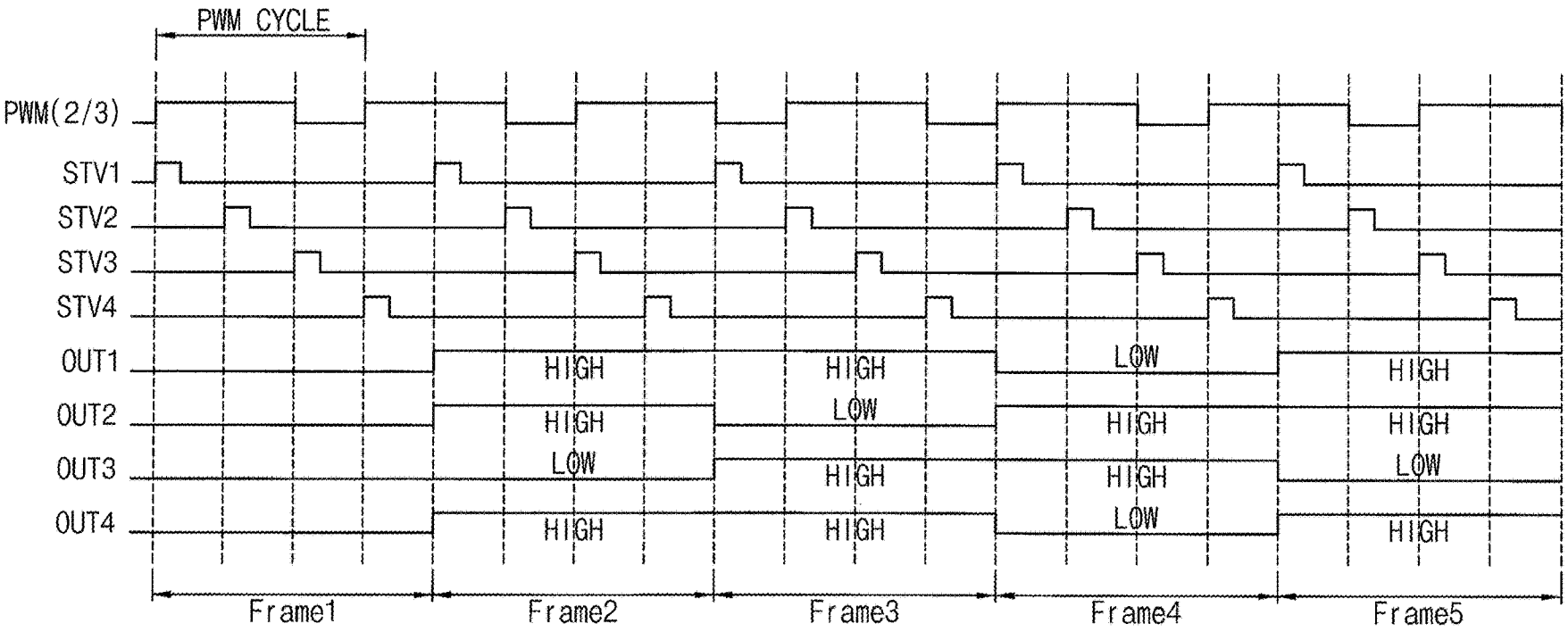
FIG. 11 is a signal timing diagram illustrating exemplary input and output signals of the gate turn on controller of FIG. 5.
Figures 12, 13:
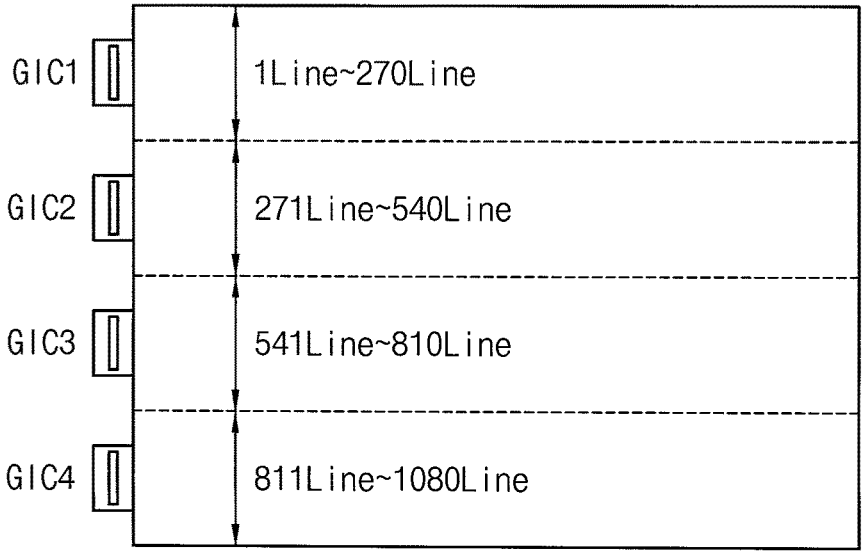
FIG. 12 is a table illustrating values stored in a register of FIG. 5 according to the input and output signals of FIG. 11.
FIG. 13 is a conceptual diagram illustrating the blocks of the display panel of FIG. 1 and blocks of a gate driver of FIG. 1.

FIG. 11 is a signal timing diagram illustrating exemplary input and output signals of the gate turn on controller of FIG. 5. FIG. 12 is a table illustrating values stored in a register of FIG. 5 according to the input and output signals of FIG. 11.

In an exemplary embodiment, as shown in FIGS. 11 and 12, the scanning cycle (Frame) of the gate signal may be different from the cycle (PWM CYCLE) of the driving signal PWM of the backlight assembly BL. The cycle (PWM CYCLE) of the driving signal PWM of the backlight assembly BL may be ¾ of the scanning cycle (Frame) of the gate signal. In such an embodiment, the duty ratio of the driving signal PWM of the backlight assembly BL may be ⅔ (about 66.67%).

Referring to FIGS. 1, 4 to 8, 11 and 12, for example, the gate turn on controller and the vertical start signal controller may be initialized during a first frame Frame1.

During a second frame Frame2, a first sampling signal of HIGH, HIGH, LOW and HIGH is stored in the first register Counter Register #1 according to the level of the driving signal PWM of the backlight assembly BL in the first frame Frame1. During a third frame Frame3, a second sampling signal of HIGH, LOW, HIGH and HIGH is stored in the second register Counter Register #2 according to the level of the driving signal PWM of the backlight assembly BL in the second frame Frame2. During a fourth frame Frame4, a third sampling signal of LOW, HIGH, HIGH and LOW is stored in the third register Counter Register #3 according to the level of the driving signal PWM of the backlight assembly BL in the third frame Frame3. During a fifth frame Frame5, a fourth sampling signal of HIGH, HIGH, LOW and HIGH is stored in the fourth register Counter Register #4 according to the level of the driving signal PWM of the backlight assembly BL in the fourth frame Frame4.

The vertical start signal controller determines that the sampling signals do not represent the periodicity during four frames Frame2 to Frame 5. Thus, the sequence of outputting the gate signals may not be adjusted so that the gate signals may be sequentially outputted to the display panel 100 in a vertical direction.

Figure 14:
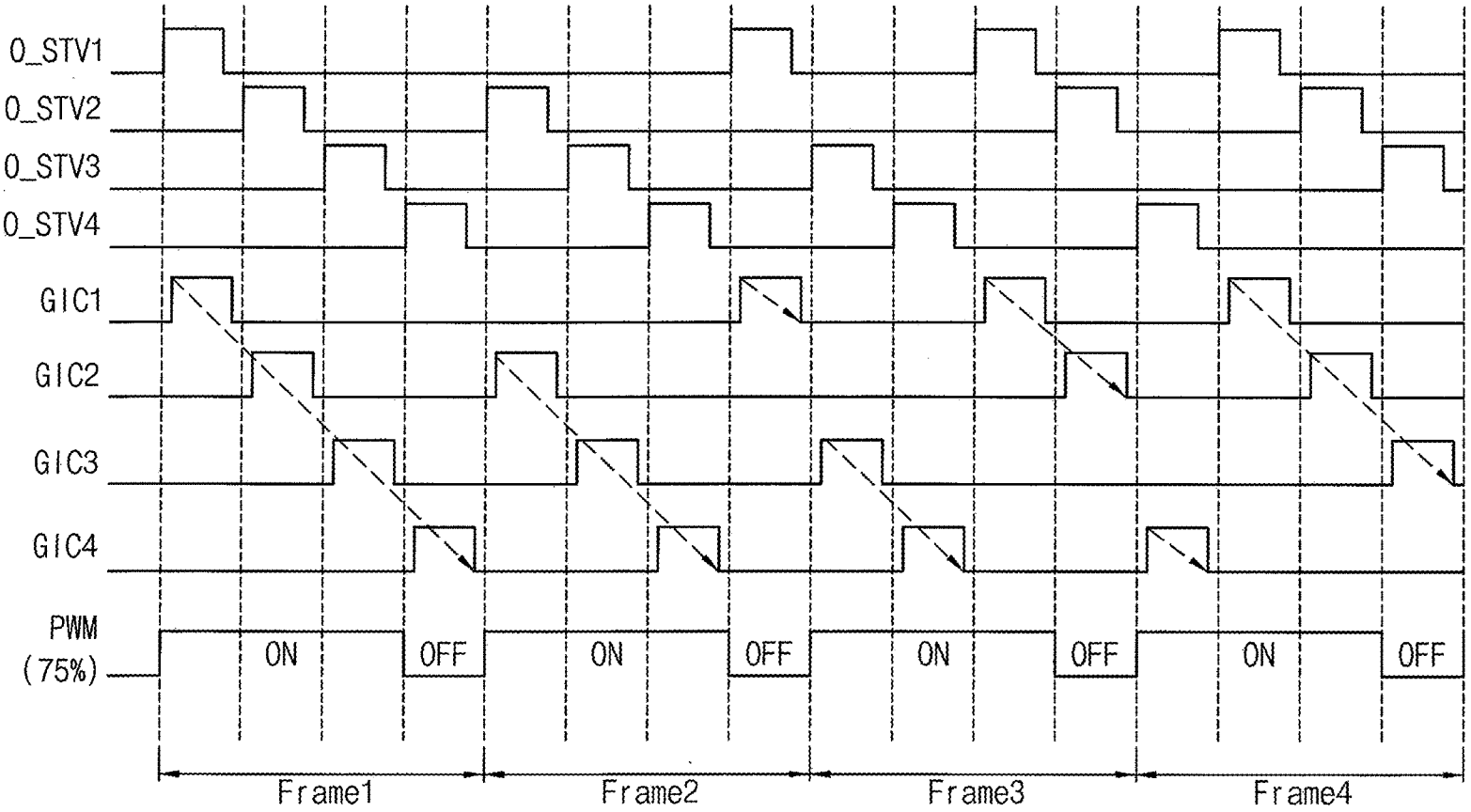

FIG. 13 is a conceptual diagram illustrating the blocks of the display panel 100 of FIG. 1 and blocks of a gate driver 300 of FIG. 1. FIGS. 14 and 15 are a signal timing diagram and a table illustrating an exemplary driving sequence of the blocks of the gate driver 300 of FIG. 13.

In an exemplary embodiment, as shown in FIGS. 14 and 15, the scanning cycle (Frame) of the gate signal may be the same as the cycle of the driving signal PWM of the backlight assembly BL. In such an embodiment, the duty ratio of the driving signal PWM of the backlight assembly BL may be about 75%.

Referring to FIGS. 1, 4 to 8 and 13 to 15, the gate driver 300 includes a plurality of driving blocks GIC1, GIC2, GIC3 and GIC4 corresponding to the display blocks BK1, BK2, BK3 and BK4 of the display panel 100, respectively. Each of the driving blocks GIC1, GIC2, GIC3 and GIC4 may be an integrated circuit chip which is directly attached to the display panel 100 or attached to the display panel 100 through a flexible printed circuit board.

Alternatively, the gate driver 300 may include a circuit part which is integrated on the display panel 100. The driving blocks GIC1, GIC2, GIC3 and GIC4 of the gate driver 300 may be defined by portions of the circuit part integrated on the display panel 100, respectively. In an exemplary embodiment, where the gate driver 300 is integrated on the display panel 100, the driving blocks GIC1, GIC2, GIC3 and GIC4 may be distinguished from each other by applying paths of the vertical start signal but may not be physically distributed from each other.

When the scanning cycle Frame of the gate signal is the same as the cycle of the driving signal PWM of the backlight assembly BL, the duty ratio of the driving signal PWM of the backlight assembly BL is 75% and the gate signals are sequentially driven in a vertical direction, a lower quarter area of the display panel 100 may have a relatively low luminance.

Thus, the sequences of driving the driving blocks GIC1, GIC2, GIC3 and GIC4 of the gate driver 300 may be set differently from each other in adjacent frames. In one exemplary embodiment, for example, the sequence of driving the driving blocks GIC1, GIC2, GIC3 and GIC4 may be 1, 2, 3 and 4 in a first frame Frame1, 4, 1, 2 and 3 in a second frame Frame2, 3, 4, 1 and 2 in a third frame Frame3, and 2, 3, 4 and 1 in a fourth frame Frame4, as shown in FIG. 14.

During the first frame Frame1, the light is not provided to the display panel 100 from the backlight assembly BL when the fourth display block BK4 corresponding to the fourth driving block GIC4 is driven. During the second frame Frame2, the light is not provided to the display panel 100 from the backlight assembly BL when the first display block BK1 corresponding to the first driving block GIC1 is driven. During the third frame Frame3, the light is not provided to the display panel 100 from the backlight assembly BL when the second display block BK2 corresponding to the second driving block GIC2 is driven. During the fourth frame Frame4, the light is not provided to the display panel 100 from the backlight assembly BL when the third display block BK3 corresponding to the third driving block GIC3 is driven.

According to an exemplary embodiment, the areas where the light is not provided from the backlight assembly BL when the area is scanned are uniformly distributed during four frames. Thus, in such an embodiment, the luminance difference among the areas of the display panel 100 according to whether the light from the backlight assembly BL is provided to the area or not may be compensated so that the display quality of the display panel 100 may be enhanced.

However, in exemplary embodiments of the invention, the driving sequence is not limited the above driving sequence (in FIG. 15). In such embodiments, the driving sequences may be variously modified to uniformly generate the areas where the light is not provided from the backlight assembly BL.

Figure 16:
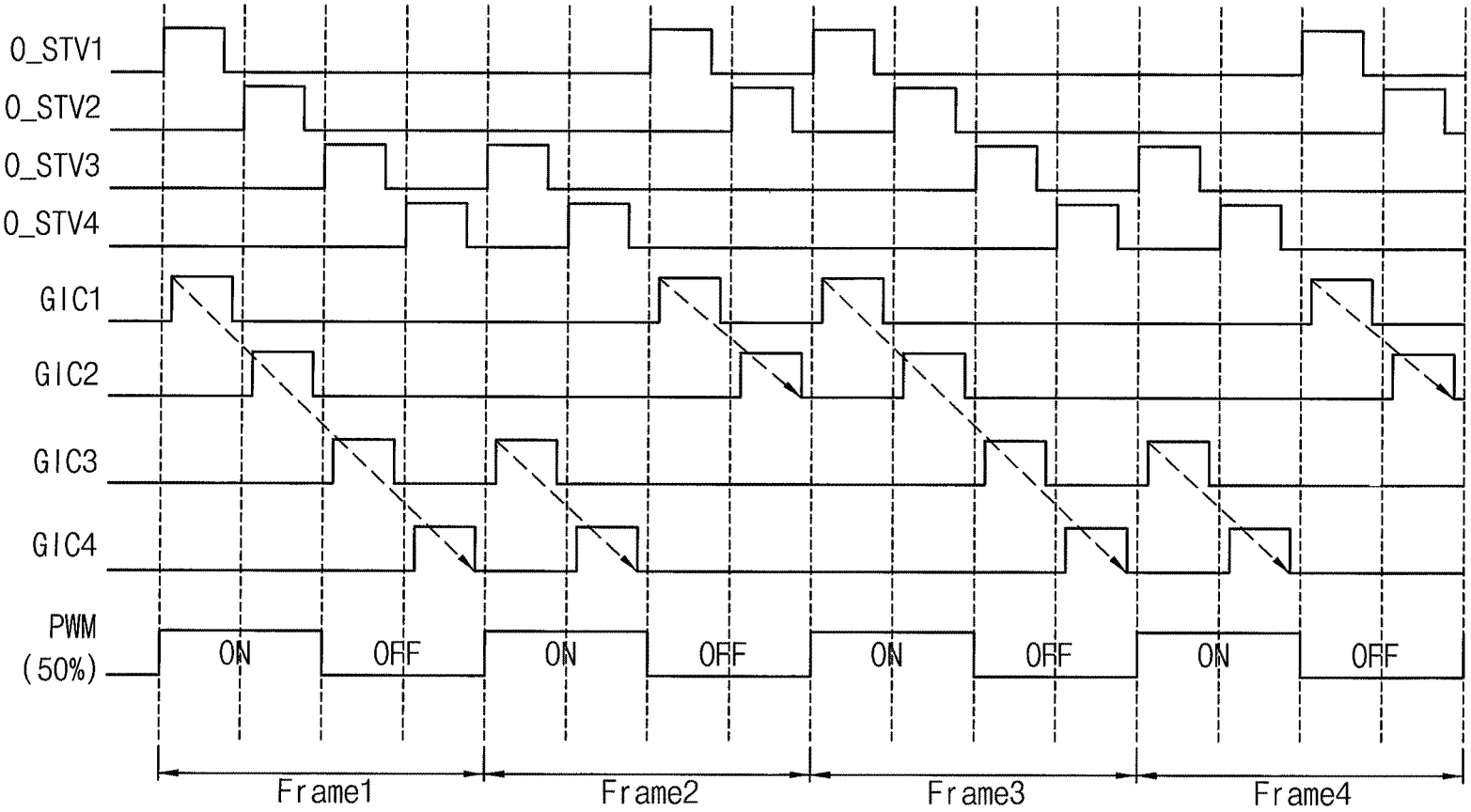

FIGS. 16 and 17 are a signal timing diagram and a table illustrating an exemplary driving sequence of the blocks of the gate driver 300 of FIG. 13.

In an exemplary embodiment, as shown in FIGS. 16 and 17, the scanning cycle (Frame) of the gate signal may be the same as the cycle of the driving signal PWM of the backlight assembly BL. In such an embodiment, the duty ratio of the driving signal PWM of the backlight assembly BL may be about 50%.

Referring to FIGS. 1, 4 to 8, 13, 16 and 17, the gate driver 300 includes a plurality of driving blocks GIC1, GIC2, GIC3 and GIC4 corresponding to the display blocks BK1, BK2, BK3 and BK4 of the display panel 100.

When the scanning cycle Frame of the gate signal is the same as the cycle of the driving signal PWM of the backlight assembly BL, the duty ratio of the driving signal PWM of the backlight assembly BL is about 50% and the gate signals are sequentially driven in a vertical direction, a lower half area of the display panel 100 may have a relatively low luminance.

Thus, in such an embodiment, the sequences of driving the driving blocks GIC1, GIC2, GIC3 and GIC4 of the gate driver 300 may be set differently from each other in adjacent frames. In one exemplary embodiment, for example, the sequence of driving the driving blocks GIC1, GIC2, GIC3 and GIC4 may be 1, 2, 3 and 4 in a first frame Frame1, 3, 4, 1 and 2 in a second frame Frame2, 1, 2, 3 and 4 in a third frame Frame3, and 3, 4, 1 and 2 in a fourth frame Frame4, as shown in FIG. 17.

During the first frame Frame1, the light is not provided to the display panel 100 from the backlight assembly BL when the third and fourth display blocks BK3 and BK4 corresponding to the third and fourth driving blocks GIC3 and GIC4 are driven. During the second frame Frame2, the light is not provided to the display panel 100 from the backlight assembly BL when the first and second display blocks BK1 and BK2 corresponding to the first and second driving blocks GIC1 and GIC2 are driven. During the third frame Frame3, the light is not provided to the display panel 100 from the backlight assembly BL when the third and fourth display blocks BK3 and BK4 corresponding to the third and fourth driving blocks GIC3 and GIC4 are driven. During the fourth frame Frame4, the light is not provided to the display panel 100 from the backlight assembly BL when the first and second display blocks BK1 and BK2 corresponding to the first and second driving blocks GIC1 and GIC2 are driven.

According to an exemplary embodiment, the areas where the light is not provided from the backlight assembly BL when the area is scanned are uniformly distributed during four frames. Thus, in such an embodiment, the luminance difference among the areas of the display panel 100 according to whether the light from the backlight assembly BL is provided to the area or not may be compensated so that the display quality of the display panel 100 may be enhanced.

However, in exemplary embodiments of the invention, the driving sequence is not limited the above driving sequence (in FIG. 17). In such embodiments, the driving sequences may be variously modified to uniformly generate the areas where the light is not provided from the backlight assembly BL.

Figure 18:
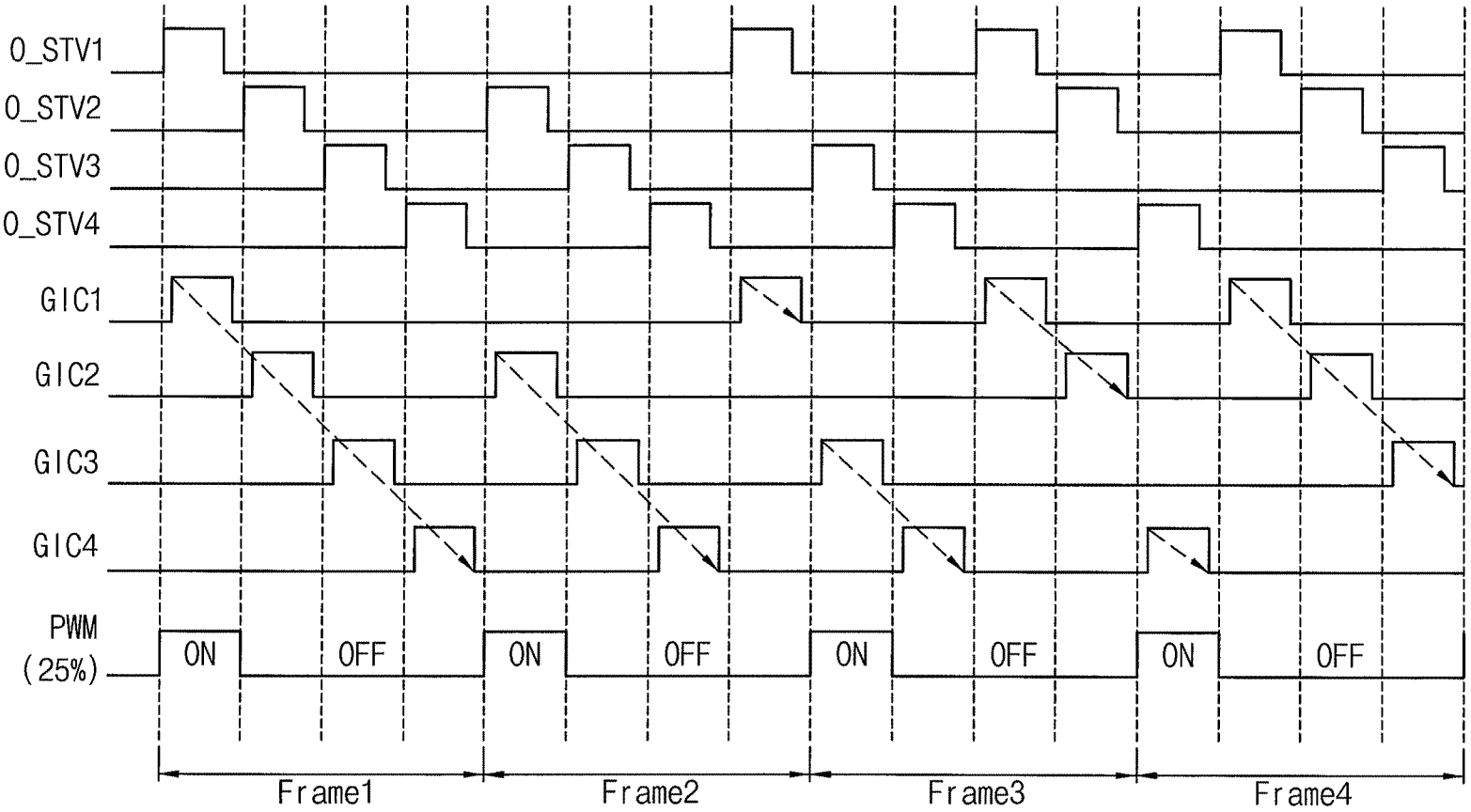

FIGS. 18 and 19 are a signal timing diagram and a table illustrating an exemplary driving sequence of the blocks of the gate driver 300 of FIG. 13.

In an exemplary embodiment, as shown in FIGS. 18 and 19, the scanning cycle (Frame) of the gate signal may be the same as the cycle of the driving signal PWM of the backlight assembly BL. In such an embodiment, the duty ratio of the driving signal PWM of the backlight assembly BL may be about 25%.

Referring to FIGS. 1, 4 to 8, 13, 18 and 19, the gate driver 300 includes a plurality of driving blocks GIC1, GIC2, GIC3 and GIC4 corresponding to the display blocks BK1, BK2, BK3 and BK4 of the display panel 100.

When the scanning cycle Frame of the gate signal is the same as the cycle of the driving signal PWM of the backlight assembly BL, the duty ratio of the driving signal PWM of the backlight assembly BL is about 25% and the gate signals are sequentially driven in a vertical direction, a lower ¾ area of the display panel 100 may have a relatively low luminance.

Thus, in such an embodiment, the sequences of driving the driving blocks GIC1, GIC2, GIC3 and GIC4 of the gate driver 300 may be set differently from each other in adjacent frames. In one exemplary embodiment, for example, the sequence of driving the driving blocks GIC1, GIC2, GIC3 and GIC4 may be 1, 2, 3 and 4 in a first frame Frame1, 4, 1, 2 and 3 in a second frame Frame2, 3, 4, 1 and 2 in a third frame Frame3, and 2, 3, 4 and 1 in a fourth frame Frame4, as shown in FIG. 19.

During the first frame Frame1, the light is not provided to the display panel 100 from the backlight assembly BL when the second, third and fourth display blocks BK2, BK3 and BK4 corresponding to the second, third and fourth driving blocks GIC2, GIC3 and GIC4 are driven. During the second frame Frame2, the light is not provided to the display panel 100 from the backlight assembly BL when third, fourth and first display blocks BK3, BK4 and BK1 corresponding to the third, fourth and first driving blocks GIC3, GIC4 and GIC1 are driven. During the third frame Frame3, the light is not provided to the display panel 100 from the backlight assembly BL when the fourth, first and second display blocks BK4, BK1 and BK2 corresponding to the fourth, first and second driving blocks GIC4, GIC1 and GIC2 are driven. During the fourth frame Frame4, the light is not provided to the display panel 100 from the backlight assembly BL when the first, second and third display blocks BK1, BK2 and BK3 corresponding to the first, second and third driving blocks GIC1, GIC2 and GIC3 are driven.

According to an exemplary embodiment, the areas where the light is not provided from the backlight assembly BL when the area is scanned are uniformly distributed during four frames. Thus, the luminance difference among the areas of the display panel 100 according to whether the light from the backlight assembly BL is provided to the area or not may be compensated so that the display quality of the display panel 100 may be enhanced.

However, in exemplary embodiments of the invention, the driving sequence is not limited the above driving sequence (in FIG. 17). In such embodiments, the driving sequences may be variously modified to uniformly generate the areas where the light is not provided from the backlight assembly BL.

Figure 20:
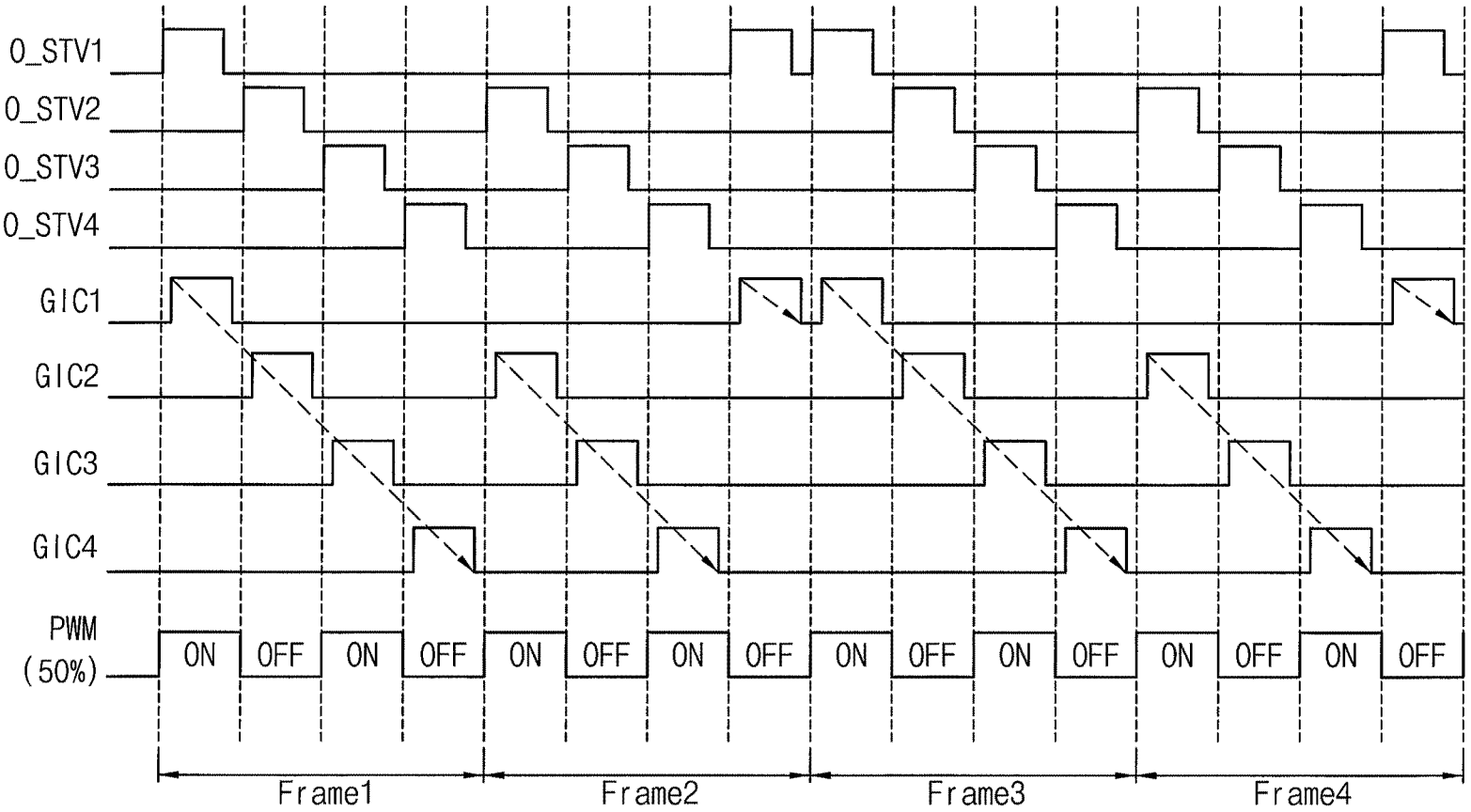

FIGS. 20 and 21 are a signal timing diagram and a table illustrating an exemplary driving sequence of the blocks of the gate driver 300 of FIG. 13.

In an exemplary embodiment, as shown in FIGS. 20 and 21, the scanning cycle (Frame) of the gate signal may be different from the cycle of the driving signal PWM of the backlight assembly BL. In such an embodiment, the duty ratio of the driving signal PWM of the backlight assembly BL may be about 50%. The scanning cycle (Frame) of the gate signal may be twice as long as the cycle of the driving signal PWM of the backlight assembly BL.

Referring to FIGS. 1, 4 to 8, 13, 20 and 21, the gate driver 300 includes a plurality of driving blocks GIC1, GIC2, GIC3 and GIC4 corresponding to the display blocks BK1, BK2, BK3 and BK4 of the display panel 100.

In an exemplary embodiment, where the scanning cycle Frame of the gate signal is twice as long as the cycle of the driving signal PWM of the backlight assembly BL, the duty ratio of the driving signal PWM of the backlight assembly BL is about 50% and the gate signals are sequentially driven in a vertical direction, an area from an upper quarter point to an upper half point and a lower quarter area of the display panel 100 may have a relatively low luminance.

Thus, the sequences of driving the driving blocks GIC1, GIC2, GIC3 and GIC4 of the gate driver 300 may be set differently from each other in adjacent frames. In one exemplary embodiment, for example, the sequence of driving the driving blocks GIC1, GIC2, GIC3 and GIC4 may be 1, 2, 3 and 4 in a first frame Frame1, 4, 1, 2 and 3 in a second frame Frame2, 1, 2, 3 and 4 in a third frame Frame3 and 4, 1, 2 and 3 in a fourth frame Frame4, as shown in FIG. 21.

During the first frame Frame1, the light is not provided to the display panel 100 from the backlight assembly BL when the second and fourth display blocks BK2 and BK4 corresponding to the second and fourth driving blocks GIC2 and GIC4 are driven. During the second frame Frame2, the light is not provided to the display panel 100 from the backlight assembly BL when first and third display blocks BK1 and BK3 corresponding to the first and third driving blocks GIC1 and GIC3 are driven. During the third frame Frame3, the light is not provided to the display panel 100 from the backlight assembly BL when the second and fourth display blocks BK2 and BK4 corresponding to the second and fourth driving blocks GIC2 and GIC4 are driven. During the fourth frame Frame4, the light is not provided to the display panel 100 from the backlight assembly BL when first and third display blocks BK1 and BK3 corresponding to the first and third driving blocks GIC1 and GIC3 are driven.

According to an exemplary embodiment, the areas where the light is not provided from the backlight assembly BL when the area is scanned are uniformly generated during four frames. Thus, the luminance difference among the areas of the display panel 100 according to whether the light from the backlight assembly BL is provided to the area or not may be compensated so that the display quality of the display panel 100 may be enhanced.

However, in exemplary embodiments of the invention, the driving sequence is not limited to the above driving sequence (in FIG. 17). In such embodiments, the driving sequences may be variously modified to uniformly generate the areas where the light is not provided from the backlight assembly BL.

According to exemplary embodiments of the display apparatus and the method of driving the display apparatus, the sequences of outputting the gate signals to the display blocks may be differently set in adjacent frames so that the display quality of the display panel may be enhanced.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A display apparatus comprising:

a display panel comprising a plurality of display blocks;

a gate driver which outputs a gate signal to the display panel;

a data driver which outputs a data voltage to the display panel; and a backlight assembly which provides light to the display panel, wherein sequences of outputting the gate signals from the gate driver to the display blocks are different from each other in adjacent frames, wherein a display block of the plurality of display blocks is in a first state when the backlight assembly provides the light to the display block and the gate signal is outputted to the display block, the display block is in a second state when the backlight assembly does not provide the light to the display block and the gate signal is outputted to the display block, and when the first state and the second state of the display blocks represent a periodicity, the sequences of outputting the gate signals from the gate driver to the display blocks are different from each other in the adjacent frames.

2. The display apparatus of claim 1, wherein when accumulated numbers of the second state of the display blocks are different from each other during a predetermined accumulation duration, the sequences of outputting the gate signals from the gate driver to the display blocks are different from each other in the adjacent frames.

3. The display apparatus of claim 1, wherein the gate driver receives a plurality of converted vertical start signals corresponding to the display blocks, and sequences of activation of the converted vertical start signals are different from each other in the adjacent frames.

4. The display apparatus of claim 3, further comprising:

a gate turn on controller comprising:

a flipflop part comprising a plurality of flipflops; and a register part comprising a plurality of registers, wherein the flipflops generate a sampling signal by sampling a driving signal of the backlight assembly using a plurality of vertical start signals, and the registers store the sampling signal.

5. The display apparatus of claim 4, wherein the gate turn on controller further comprises:

a switch part comprising a plurality of switches connected between the plurality of flipflops and the plurality of registers; and a decoder which controls operations of the switches of the switch part.

6. The display apparatus of claim 5, wherein the display apparatus comprises four display blocks, the flipflop part comprises:

first and second flipflops connected to each other in series;

third and fourth flipflops connected to each other in series;

fifth and sixth flipflops connected to each other in series; and seventh and eighth flipflops connected to each other in series, a first vertical start signal corresponding to a first display block of the four display blocks is applied to the first flipflop, and the first vertical start signal is applied to the second flipflop, a second vertical start signal corresponding to a second display block of the four display blocks is applied to the third flipflop, and the first vertical start signal is applied to the fourth flipflop, a third vertical start signal corresponding to a third display block of the four display blocks is applied to the fifth flipflop, and the first vertical start signal is applied to the sixth flipflop, and a fourth vertical start signal corresponding to a fourth display block of the four display blocks is applied to the seventh flipflop, and the first vertical start signal is applied to the eighth flipflop.

7. The display apparatus of claim 6, wherein the display panel comprises four display blocks, and the register part comprises:

a first register connected to the second, fourth, sixth and eighth flipflops to store a first sampling signal of four bits, which is outputted from the second, fourth, sixth and eighth flipflops during a first duration;

a second register connected to the second, fourth, sixth and eighth flipflops to store a second sampling signal of four bits, which is outputted from the second, fourth, sixth and eighth flipflops during a second duration;

a third register connected to the second, fourth, sixth and eighth flipflops to store a third sampling signal of four bits, which is outputted from the second, fourth, sixth and eighth flipflops during a third duration; and a fourth register connected to the second, fourth, sixth and eighth flipflops to store a fourth sampling signal of four bits, which is outputted from the second, fourth, sixth and eighth flipflops during a fourth duration.

8. The display apparatus of claim 7, wherein the display panel comprises four display blocks, and the decoder generates a control signal of four bits to control switches connected between the second, fourth, sixth and eighth flipflops and the first to fourth registers based on control bits of two bits.

9. The display apparatus of claim 4, further comprising:

a vertical start signal controller which generates the converted vertical start signal based on the sampling signal.

10. The display apparatus of claim 9, wherein the vertical start signal generates the converted vertical start signal when the sampling signal corresponding to the display blocks represents a periodicity.

11. The display apparatus of claim 10, wherein the sampling signal has a first level and a second level, when accumulated numbers of the second levels of the sampling signals corresponding to the display blocks are different from each other during a predetermined accumulation duration, the vertical start signal controller generates the converted vertical start signals.

12. A method of driving a display apparatus, the method comprising:

outputting a gate signal to a plurality of display blocks of a display panel of the display apparatus;

outputting a data voltage to the display panel; and providing light to the display panel, wherein sequences of outputting the gate signals to the display blocks are different from each other in adjacent frames, wherein a display block of the plurality of display blocks is in a first state when the light is provided to the display block and the gate signal is outputted to the display block, the display block is in a second state when the light is not provided to the display block and the gate signal is outputted to the display block, and when the first state and the second state of the display blocks represent a periodicity, the sequences of outputting the gate signals to the display blocks are different from each other in the adjacent frames.

13. The method of claim 12, wherein when accumulated numbers of the second state of the display blocks are different from each other during a predetermined accumulation duration, the sequences of outputting the gate signals to the display blocks are different from each other in the adjacent frames.

14. The method of claim 12, wherein a gate driver of the display device, which outputs the gate signal to the display panel, receives a plurality of converted vertical start signals corresponding to the display blocks, sequences of activation of the converted vertical start signals are different from each other in the adjacent frames.

15. The method of claim 14, further comprising:

generating a sampling signal by sampling a driving signal of a backlight assembly of the display device, which provides the light to the display panel, using a plurality of vertical start signals from a plurality of flipflops; and storing the sampling signal to a plurality of registers.

16. The method of claim 15, further comprising:

controlling operations of a plurality of switches connected between the flipflops and the registers.

17. The method of claim 15, further comprising:

generating the converted vertical start signals based on the sampling signal stored in the registers.

* * * * *